US006082068A

United States Patent [19]

Fisher

[11] Patent Number: 6,082,068

[45] Date of Patent: Jul. 4, 2000

[54] METHOD AND APPARATUS FOR ASSEMBLING A LIGHTWEIGHT STACKABLE TRUSS

[75] Inventor: Mark E. Fisher, London, United Kingdom

[73] Assignee: Tomcat Global Corporation, Midland, Tex.

[21] Appl. No.: 09/169,488

[22] Filed: Oct. 9, 1998

[51] Int. Cl.[7] ..... E04B 1/18; E04C 3/02

[52] U.S. Cl. ..... 52/633; 52/638; 52/650.1; 52/651.03; 52/652.1; 211/182

[58] Field of Search ..... 52/633, 637, 638, 52/650.1, 652.1, 653.1, 653.2, 655.1, 651.03, 649.2, 645, 650.01–650.02, 650.07–650.09, 650.2; 248/163.2; 403/256, 262, 171; 211/182, 22

[56] References Cited

U.S. PATENT DOCUMENTS

| | | | |
|---|---|---|---|
| 1,181,013 | 4/1916 | Inglis | 52/652.1 X |
| 1,757,825 | 5/1930 | Albach | 248/163.2 X |
| 2,855,617 | 10/1958 | Broms et al. | 52/646 X |
| 3,111,207 | 11/1963 | Braddon | 52/650.1 |
| 3,704,849 | 12/1972 | Green | 248/163 |
| 4,494,349 | 1/1985 | Clements | 52/650.1 X |
| 5,205,101 | 4/1993 | Swan et al. | 51/650.1 |
| 5,406,767 | 4/1995 | Peach et al. | 52/645 X |
| 5,484,634 | 1/1996 | Schutze | 52/653.2 X |

FOREIGN PATENT DOCUMENTS

| | | |
|---|---|---|
| 859752 | 11/1956 | United Kingdom . |
| 1088460 | 7/1965 | United Kingdom . |
| 1320777 | 6/1969 | United Kingdom . |

*Primary Examiner*—Carl D. Friedman
*Assistant Examiner*—Winnie Yip
*Attorney, Agent, or Firm*—Jones, Day, Reavis & Pogue

[57] ABSTRACT

A method and apparatus for forming a lightweight truss that can be used in temporary, demountable form for structures used in various constructions such as exhibitions, displays, and concerts and is formed of precut lengths of chords (tubes) and V-shaped members that can be detachably connected to each other to form an inverted V-shaped truss that can be stacked when stored and that can be disassembled into its component elements for shipping.

22 Claims, 4 Drawing Sheets

METHOD AND APPARATUS FOR ASSEMBLING A LIGHTWEIGHT STACKABLE TRUSS

BACKGROUND OF THE INVENTION

1. Field of the Invention

The present invention relates in general to stackable trusses and in particular to a V-shaped stackable truss for use in temporary, demountable construction for exhibition, display, and concert staging.

2. Description of Related Art Including Information Disclosed Under 37 CFR 1.97 and 1.98

It is well known in the prior art that there is a great need for the construction of exhibition, display, and concert staging that requires the use of truss members that can be connected together in a well-known fashion to form the finished stage or exhibition. Many of these exhibitions or staging displays are quite elaborate and are associated with groups such as music groups that travel from one location to another to perform concerts. This means that the staging must be shipped to the desired location, assembled, the concert performed, the staging disassembled, and shipped again to the next location for the next concert.

As is well known, the shipping of the truss units is very expensive because the assembled truss units require a great amount of space. This means, of course, that the greater the number of trucks and personnel that are required to ship the staging trusses, the greater is the expense.

In an effort to cut down on the space required, copending application Ser. No. 08/902,404 entitled "Truss" was filed on Aug. 9, 1996 to provide a V-shaped stackable truss that could be stacked in a snug manner to take up less space during shipment. This enables the truss members to be shipped from one location to another at a much less cost than previously required.

It would be extremely advantageous to have a lightweight truss that could be used in temporary, demountable constructions by simplifying the fabrication of the truss, reducing the number of parts required, and by simplifying the assembly process.

SUMMARY OF THE INVENTION

The present invention enables the fabrication of a lightweight truss for use in temporary, demountable constructions for use in presentations such as exhibition, display, and concert staging. It simplifies the fabrication of the truss by reducing the number of parts required and by simplifying the assembly process. The truss is assembled from precut lengths of elongated support members such as hollow tubes (chords) prefitted with end connectors and "V-shaped" members. A bracket is associated with the apex of each V-shaped member and with each leg outer end for receiving a corresponding elongated support member. In one embodiment, the bracket is a hollow cylindrical duct segment or boss that can slidably receive a precut length of hollow tube through corresponding ones of the hollow cylindrical duct segments on the V-shaped member to form the V-shaped stackable truss. Aligned orifices can be formed in each of the hollow cylindrical duct segments and its corresponding hollow tube and a removable pin inserted in the aligned orifices to rigidly connect each of the hollow tubes to its corresponding V-shaped member.

In a second preferred embodiment, the bracket means associated with the apex of each V-shaped member and with each leg outer end is an arcuate segment with a plate extending outwardly from the arcuate segment. Each of the hollow tubes has spaced, aligned slots therein. In this manner, a precut length of the hollow tube can be placed on corresponding ones of the arcuate segments on the V-shaped member such that the vertical plate is inserted in the corresponding aligned slot. Again, aligned orifices in each of the plates and its corresponding hollow tube enable a pin to be removably inserted in the aligned orifices to rigidly connect each of the hollow tubes to its corresponding V-shaped member.

Thus, in each of the embodiments, a triangular truss of equilateral cross section is designed that does not require bracing in the bottom plane. Because there is no bracing in the bottom plane, trusses may be stacked on top of each other in a nested manner. This is an efficient, high-density packing arrangement that is a great advantage in a truss which will be stored when not in use, disassembled, and transported from place-to-place where it can be reassembled. As can be seen, the truss is assembled from a small number of components including simply the V-shaped members and the precut lengths of the support members or tubes.

The V-shaped members may be mass-produced using conventional manufacturing processes. Further, the V-shaped members and the chords can be quickly fitted together by unskilled labor. The truss can be made to any convenient length using as many of the V-shaped members as necessary.

The V-shaped members may be made from die-cast aluminum or injection-molded reinforced plastics. The chords also may be made from either aluminum or plastic composites such as carbon fiber reinforced plastic.

It will be understood that the strength of the truss can be varied by adjusting the spacing of the V-shaped members on the chords and/or by varying the wall thickness of the chord tubes.

An important feature of the present invention is that it can disassembled quickly, shipped to the desired location in component form, and assembled by unskilled labor at the location where the truss is needed. This enables a great savings in transportation costs because of the density of the shipments that can be made when the truss is disassembled.

Thus, it is an object of the present invention to provide a lightweight V-shaped stackable truss for use in temporary, demountable constructions.

It is another object of the present invention to simplify the fabrication of a truss by reducing the number of parts required and by simplifying the assembly process.

It is yet another object of the present invention to assemble a lightweight truss from precut lengths of tubes or chords prefitted with end connectors and V-shaped members having hollow cylindrical duct segments or bosses at the apex and at the outer end of each leg such that the chords can be inserted in the tubular duct segments or bosses and fixed in place by pins or other attachment devices.

It is still another object of the present invention to provide a truss assembled from precut lengths of tubes or chords prefitted with end connectors and V-shaped members having a vertical plate extending from the apex and the outer end of each leg for insertion into a slot into the chords or tubes and again fixed in place by pins or other devices.

It is also another object of the present invention to provide a lightweight truss with an inverted V-shape that allows the trusses to be stacked while enabling the trusses to be quickly assembled or disassembled.

It is still another object of the present invention to provide a lightweight V-shaped truss that is assembled from a small number of components.

It is also an object of the present invention to provide a V-shaped member having a design that can create a triangular truss of equilateral cross section that does not require bracing in the bottom plane and therefore allows the trusses to be stacked on top of each other in a nested manner.

Thus, the present invention relates to a method of assembling a lightweight stackable truss for use in temporary, demountable construction comprising the steps of providing precut lengths of elongated support members, each elongated support member having first and second ends, providing a plurality of V-shaped members, each having an apex and two depending legs, each leg having an outer end, associating a bracket with the apex of each V-shaped member and with each leg outer end for receiving a corresponding elongated support member, and detachably connecting each of the elongated support members to a corresponding one of the brackets on a plurality of spaced ones of the V-shaped members to create a V-shaped stackable truss that may be disassembled for shipping and stacked for storing.

The invention also relates to a lightweight stackable truss for use in temporary, demountable construction comprising precut lengths of elongated support members, a plurality of V-shaped members, each having an apex and two depending legs, each leg having an outer end, a bracket associated with the apex of each V-shaped member and with each leg outer end for receiving a corresponding elongated support member, and connecting means for detachably connecting each of the elongated support members to a corresponding one of the brackets on a plurality of spaced ones of the V-shaped members to create a V-shaped stackable truss that may be disassembled for shipping and stacked for storing.

BRIEF DESCRIPTION OF THE DRAWINGS

These and other features of the present invention will be more fully disclosed when taken in conjunction with the following Detailed Description of the Preferred Embodiment(s) in which like numerals represent like elements and in which.

DETAILED DESCRIPTION OF THE PREFERRED EMBODIMENT(S)

Figure 1:
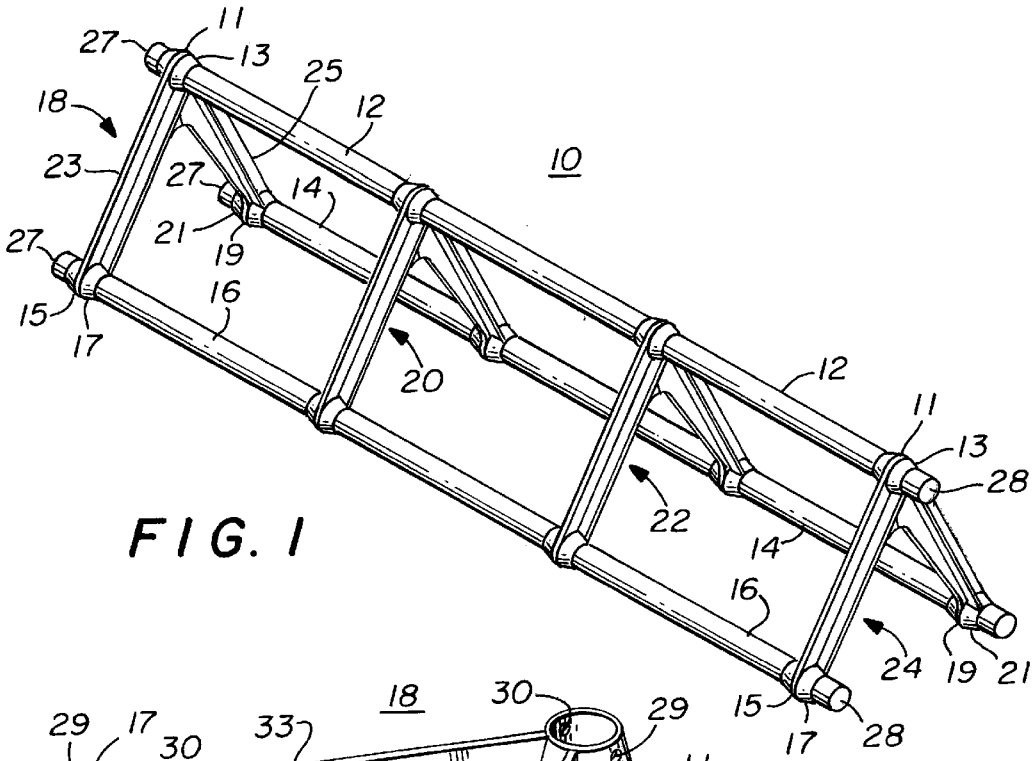
FIG. 1 is a perspective view of a single truss formed by the present invention.

FIG. 1 is a perspective view of a lightweight stackable truss 10 for use in temporary, demountable construction. It has precut lengths of elongated support members 12, 14, and 16 which may be in the form of hollow tubing. A plurality of V-shaped members 18, 20, 22, and 24 support the hollow tube members 12, 14, and 16. Each of the V-shaped members 18–24 has an apex 11 and two depending legs 23, 25, each leg having a corresponding outer end 15, 19. Bracket means 13 is associated with the apex 11 of each V-shaped member 18–24, and bracket means 17 and 21 are associated with each corresponding leg outer end 15 and 19. Each of the bracket means 13, 17, and 21, in this case, is a hollow cylindrical duct segment or boss that slidably receives a corresponding elongated support member or hollow tube 12, 14, or 16. Each of the hollow tube support members 12–16 is detachably connected to a corresponding one of the hollow duct segments 13, 17, and 21 on the plurality of spaced V-shaped members 18–24 to create a V-shaped stackable truss 10 that may be disassembled for shipping and stacked for storing while in the assembled state.

It can be seen that, with the hollow support tubes 12, 14, and 16 of precut length and the V-shaped brackets 18, 20, 22, and 24, assembly of the V-shaped truss is a very simple procedure. The method of assembling the lightweight stackable truss comprises the steps of providing precut lengths of elongated support members 12, 14, and 16, each elongated support member having first and second ends 27 and 28, providing a plurality of V-shaped members 18, 20, 22, and 24, each V-shaped member having an apex 11 and two depending legs 23, 25 with each leg having an outer end 15, 17. By associating bracket means 13, 17, and 21 with the apex 11 of each V-shaped member 18–24 and with each leg outer end 15, 17, a corresponding elongated support member 12, 14, and 16 can be received by the bracket means. Each of the elongated support members 12, 14, and 16 is then detachably connected to a corresponding one of the bracket means 13, 17, and 21 on a plurality of spaced ones of the V-shaped members 18–24 to create a V-shaped stackable truss 10 that may be disassembled for shipping and stacked for storing.

By forming each of the precut lengths of elongated support members as hollow tubes 12, 14, and 16, and by forming each of the bracket means 13, 17, and 21 on the apex 11 of each V-shaped member 18–24 and each outer leg 15 and 19 as a hollow cylindrical duct segment, a precut length of each of the hollow tubes 12, 14, and 16 can be simply slid through corresponding ones of the hollow cylindrical duct segments 13, 17, and 21 on the V-shaped members 18–24 to form the V-shaped stackable truss.

Thus, assembly and disassembly of the truss 10 shown in FIG. 1 is a simple procedure that can be performed by unskilled labor.

Figure 2:
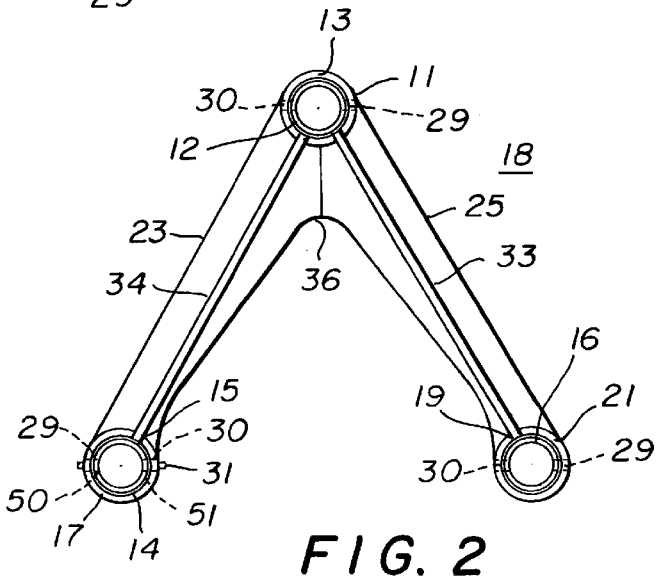
FIG. 2 is an end view of one of the V-shaped members of the truss of FIG. 1 illustrating the shape of the V-shaped member.

FIG. 2 is a front view of one of the V-shaped members 18 illustrating the apex 11 and the two depending legs 23 and 25 with leg 23 having an outer end 15 and leg 25 having an outer end 19. It can be seen that a hollow cylindrical duct segment 13 is formed at the apex 11 of the V-shaped member 18 while hollow cylindrical duct segment 17 is formed at the outer end 15 of leg 23 and hollow cylindrical duct segment 21 is formed at the outer end 19 of leg 25. A cross section of a hollow tube 12, 14, 16 is shown inserted in corresponding ones of the hollow cylindrical duct segments 13, 17, and 21. As can be seen on the outer end 15 of leg 23, orifices 29 and 30 are formed in opposing sides of the cylindrical duct segment 17 and corresponding orifices 50 and 52 are formed in opposite sides of hollow tubes 12, 14, and 16 to detachably connect each tube segment 12, 14, and 16 to its associated hollow cylindrical duct segment 11, 17, and 21. These orifices are all in aligned relationship as shown. A pin 31 is inserted through the aligned orifices to rigidly attach each V-shaped member 18–24 to the hollow tubes 12, 14, and 16.

Figure 3:
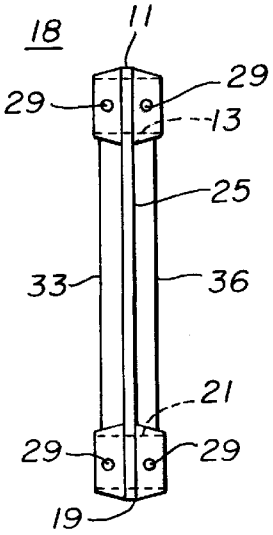
FIG. 3 is a side view of a V-shaped member.

To strengthen the V-shaped members, braces or spars 33 and 34 are formed perpendicular to each leg 23 and 25 as shown. These braces can be better seen in FIG. 3, which is a side view of the V-shaped member 18 and it can be seen that the braces 33 and 36 extend in a direction perpendicular to each side of leg 25. In like manner, brace 34 and a corresponding brace on the opposite side, not shown, extend in a direction perpendicular to leg 23.

Figure 4:
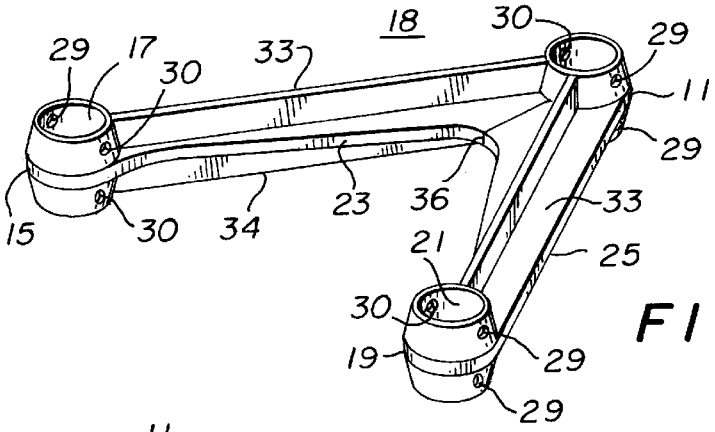
FIG. 4 is a perspective view of one of the novel V-shaped members.

FIG. 4 is an isometric view of one of the members 18 illustrating the hollow cylindrical duct segments 13, 17, and 21 at the apex 11 and the outer end 15 and 19 of depending legs 23 and 25, respectively. These hollow cylindrical duct segments form the bracket support means and each slidably elongated support elongated support members in the form of a hollow tube. The orifices 29 and 30 in each of the hollow cylindrical duct segments are illustrated. It is through these orifices, which are aligned with corresponding orifices in the hollow tubes 12, 14, and 16, that pins are inserted to rigidly attach the hollow tube members to each of the V-shaped members. FIG. 4 shows the leg brace 34' on the opposite side of leg brace 33 both of which are perpendicular to depending leg 23. It will also be noticed in FIG. 4 that the two legs are joined at an interior apex 36, which is utilized for stacking the V-shaped trusses as will be shown hereafter.

Figure 5:
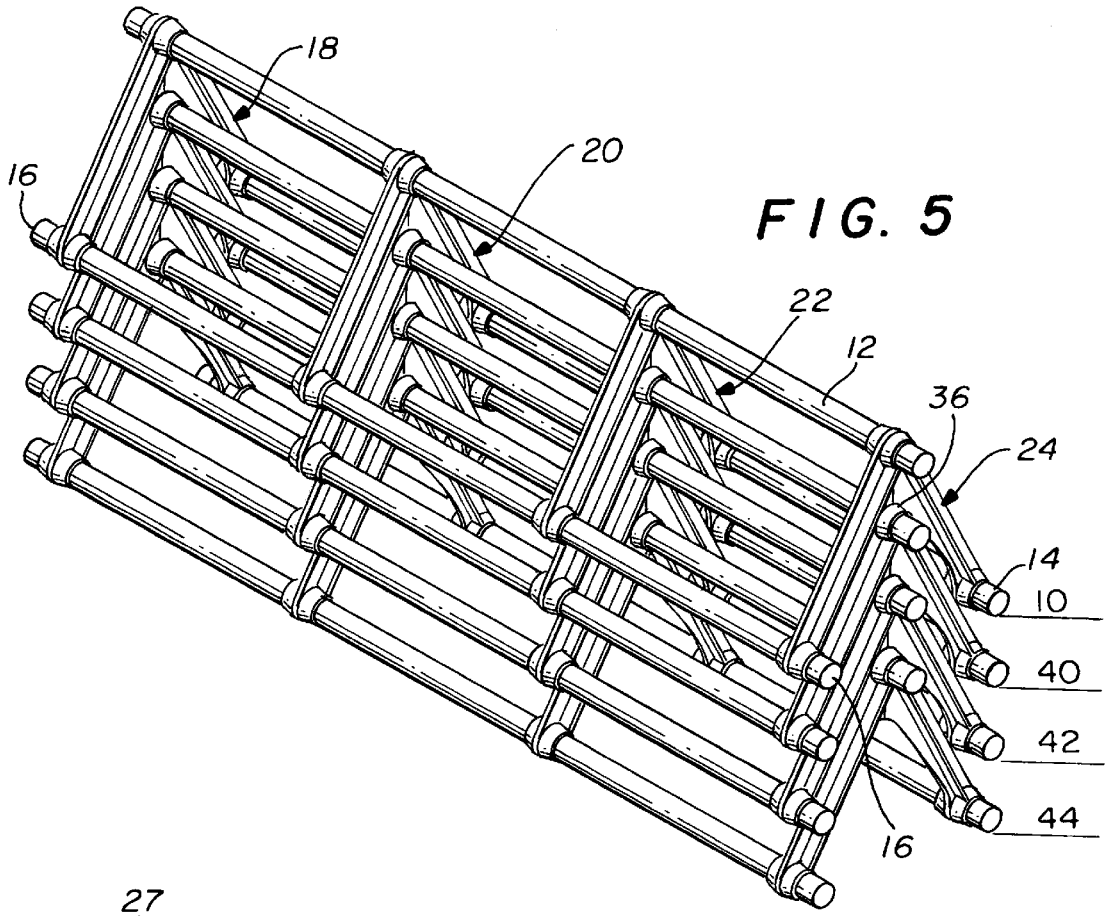
FIG. 5 is a perspective view of a number of the trusses of FIG. 1 in stacked relationship.

FIG. 5 is a perspective view illustrating four truss members 10, 40, 42, and 44 in a stacked relationship. It will be seen that the apex 11 of each V-shaped member 18, 20, 22, and 24 nests in the interior apex 36 of the V-shaped member above it.

From FIG. 1 it can be clearly seen that if it is desired to increase the strength of the V-shaped stackable truss 10, it is merely necessary to add more V-shaped members 18, 20, 22, and 24 to the three elongated support members 12, 14, and 16 and decrease the spacing between them.

Further, the V-shaped members and the elongated support members may be formed of any sturdy, lightweight material such as die-cast aluminum or carbon fiber reinforced plastic. In either case, the material is both lightweight and strong, thus enabling a lightweight truss to be constructed.

The preferred embodiment of the invention is illustrated in FIGS. 6–12. Again, in FIG. 6, it can be seen that the V-shaped truss 10' is comprised simply of elongated support members 12, 14, and 16 and a plurality of V-shaped members 18, 20, 22, and 24. The V-shaped members each have a bracket 13' at the apex and a bracket 17' and 21' at the outer ends of each of the legs 23 and 25. By detachably connecting each of the elongated support members 12, 14, and 16 to a corresponding one of the brackets 13', 17', and 21', a V-shaped stackable truss 10' is created that may be disassembled for shipping and stacked for storing. The only difference between the preferred embodiment of FIG. 6 and that of FIG. 1 is the type of bracket that is associated with the apex 11 and each leg outer end 15 and 17 of the V-shaped members.

Figure 7:
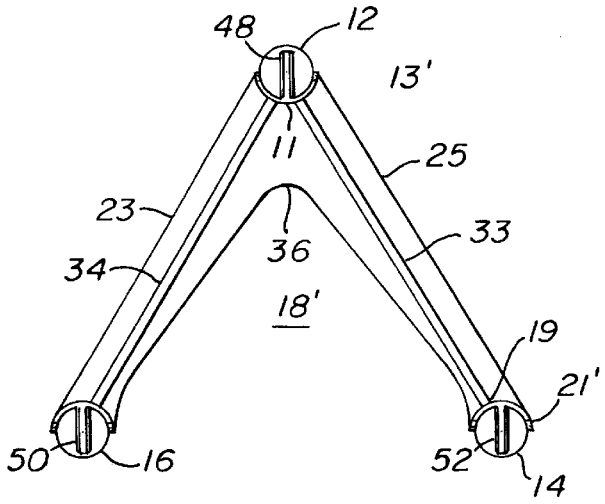
FIG. 7 is an end view of one of the V-shaped members used in the truss of FIG. 6.
Figure 10:
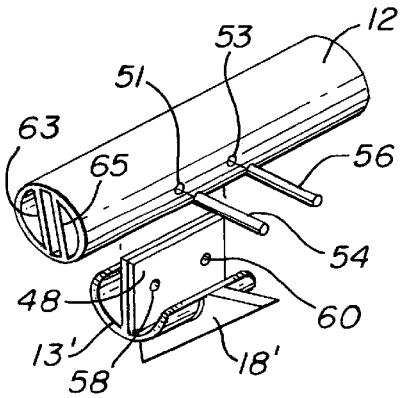
FIG. 10 is an exploded view of a portion of the V-shaped member and the tubing illustrating how a plate on the V-shaped member is inserted in a slot in the tubing to attach the tubing to the V-shaped member.
Figure 11:
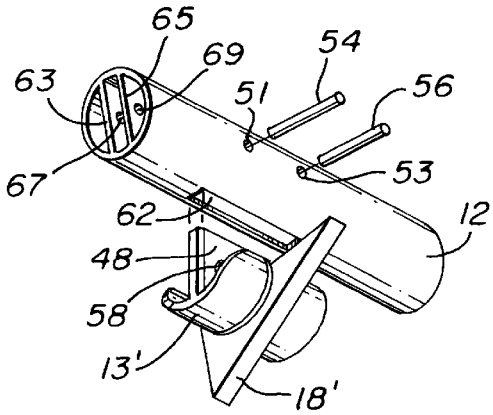
FIG. 11 is a bottom view of the tube in FIG. 10 illustrating the slot in which the plate of the V-shaped member is inserted.

FIG. 7 is a front view of one of the V-shaped members 18 of the preferred embodiment. Here, the bracket 13' associated with the apex 11 is in the form of an arcuate segment with a plate 48 extending vertically outwardly from the arcuate segment 13' in its normal position of use as shown. Likewise, the outer end 15 of leg 23 has plate 50 extending vertically outwardly therefrom and the bracket 21' at the outer end 19 of leg 25 is also an arcuate segment having a plate 52 extending vertically outwardly therefrom as shown. By providing a slot 62 (see FIG. 11) in each of the elongated tube members 12, 14, and 16, the plates 48, 50, and 52 can be inserted in the slots in the tubes and attached thereto by means of pins as illustrated in FIGS. 10 and 11. The preferred embodiment shown in FIG. 7 is especially useful with the strengthened hollow tube support member or chord disclosed in commonly assigned copending application Ser. No. 09/168,725 entitled "Method and Apparatus for Strengthening an Elongated Hollow Tube Support Member", filed of even date herewith. In that application, two spaced ribs are formed on the interior of the elongated chord to strengthen it. Thus, plate 48 of FIG. 7 (and plates 50 and 52 on the outer ends of the depending legs) could be inserted in a slot in the chord between the two ribs and attached thereto as stated above.

Figure 6:
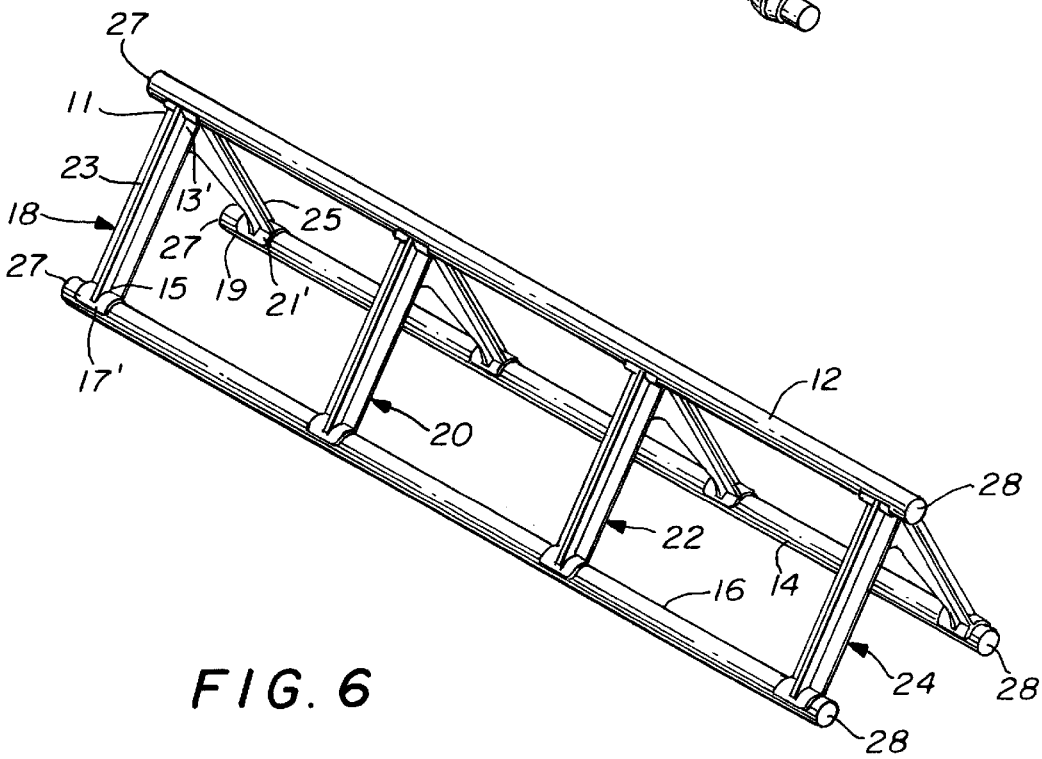
FIG. 6 is an isometric view of a second preferred embodiment of a novel truss of the present invention.
Figure 8:
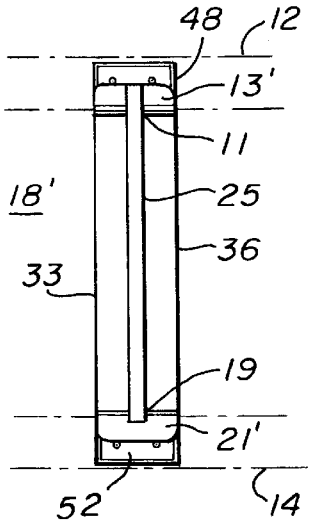
FIG. 8 is a side view of the V-shaped member of FIG. 7.

Thus the method of assembling this truss shown in FIG. 6 is substantially identical to the method of assembling the truss 10 shown in FIG. 1. Each elongated support member is provided with a precut length and has first and second ends 27 and 28. A plurality of V-shaped members are provided with each V-shaped member having an apex 11 and two depending legs 23 and 25 with each leg having an outer end 15, 17. Brackets 13, 17, and 21 are associated with the apex 11 of each V-shaped member and with each leg outer end 15 and 17 for receiving a corresponding elongated support member (tube) 12, 14, 16. Each of the elongated support members 12, 14, and 16 is detachably connected to a corresponding one of the brackets on a plurality of spaced ones of the V-shaped members 18–24 to create a V-shaped stackable truss 10' that may be disassembled for shipping and stacked for storing.

In this particular embodiment, as stated earlier, each of the bracket means 13, 17, and 21 is associated with a corresponding one of each V-shaped member apex 11 and with each leg outer end 15, 19 as an arcuate segment 13', 17', 21'with plate 48, 52, 56 extending vertically outwardly from its corresponding arcuate segment 13', 17', 21' in its normal position of use as shown. By placing a precut length of hollow tube 12, 14, 16 in corresponding ones of the arcuate segments 13', 17', and 21' on the V-shaped members 18–24 with the corresponding vertical plate 48, 52, 56 inserted in the corresponding aligned slot 62 in the hollow tubes 12–16 as shown, the V-shaped members can be attached to the elongated tubular support members.

Figure 9:
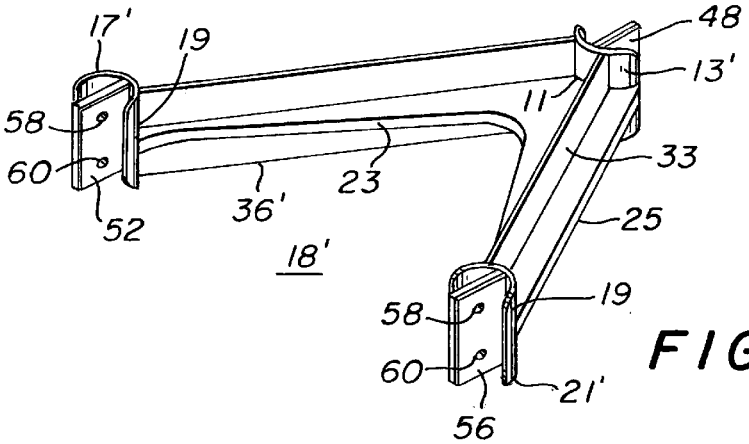
FIG. 9 is an isometric view of the V-shaped member of FIG. 7.

FIG. 9 is a perspective view of the V-shaped member 18' illustrating each of the arcuate segments 13', 17', and 21' with its corresponding plate 48, 52, and 56 extending vertically therefrom. It also illustrates the strengthening braces 33, 34, and 36' formed on each of the depending legs 23 and 25 as shown.

As shown in more detail in FIGS. 10 and 11, by aligning orifices 51, 53, 58, and 60 in each of the plates 48, 52, and 56 and their corresponding hollow tubes 12, 14, and 16, a removable pin 54, 56 can be inserted in the aligned orifices 51, 53, 58, and 60 and each of the hollow tubes 12–16 is rigidly connected to its corresponding V-shaped members 18–24 arcuate segments 13', 17', 19'.

In FIG. 10, the arcuate segment 13' at the apex 11 of a portion of the V-shaped member 18' shown has the plate 48 extending vertically therefrom with orifices 58 and 60 therein. When the plate 48 is inserted in the slot 62 of tube 12, as illustrated in FIG. 11, orifices 58 and 60 are aligned with orifices 51 and 53 in the tubing 12. Pins 54 and 56 can then be removably inserted into the aligned orifices thereby rigidly attaching the V-shaped member 18' to the elongated tube 12.

Figure 12:
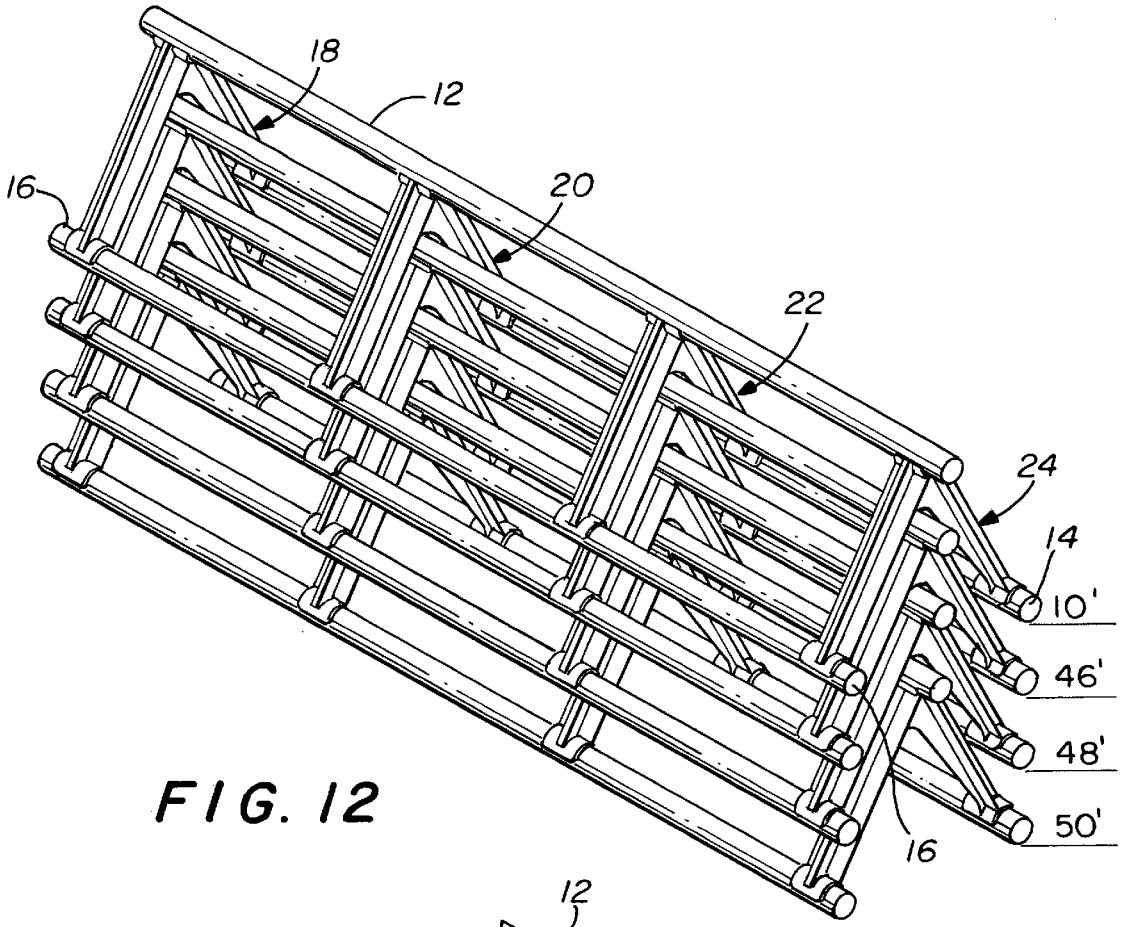
FIG. 12 is a perspective view of a number of the trusses of the second embodiment in stacked relationship.

FIG. 12 illustrates a plurality of the V-shaped stackable trusses of the preferred embodiment shown in stacked relationship.

Figure 13:
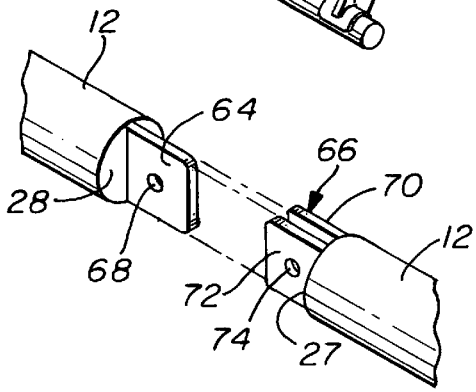
FIG. 13 is an illustration of a prior art plate and clevis that can be used to couple two adjacent trusses together.

If it is desired to couple a plurality of trusses together to form an elongated truss, well-known connectors can be utilized on each end 27 and 28 of each of the elongated support members or tubes 12, 14, and 16 to couple them together. As shown in FIG. 13, a well-know spade 64 may be coupled to end 28 of tube 12 and fork 66, having spaced sides 70 and 72, may be attached to the end 27 of an adjacent tube or elongated support member 12. By inserting the spade 64 between the sides 70 and 72 of clevis or fork 66 and inserting a pin (not shown) in orifices 68 and 72, the two trusses are connected together. Of course, the connectors would have to be provided on the end of each of the elongated support members 12, 14, and 16.

Figure 14:
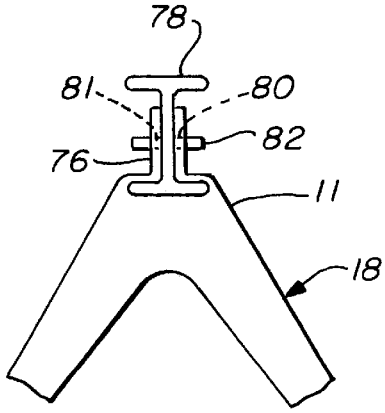
FIG. 14 is an illustration of a bracket on a V-shaped member that can receive an I-beam shaped support member.

Again, the elongated support members would not have to be limited to hollow tubes as shown in the preferred embodiment in FIG. 6 and in the first embodiment in FIG. 1. For instance, as shown in FIG. 14, the apex 11 of the V-shaped member 18 may have formed thereon a T-shaped hollow bracket 76. This bracket may slidably receive at least a portion of an elongated I-beam support member 78 as shown. By providing orifices 81 in the T-shaped bracket 76 and an orifice 80 in the I-beam 78 in aligned relationship, a pin 82 can be inserted therethrough to detachably connect the I-beam 78 to the T-shaped support 76. Thus, the invention is not limited to strictly elongated hollow tubes although they are the preferred embodiment.

Thus there has been disclosed a novel apparatus and process for forming a lightweight truss for use in temporary, demountable constructions such as exhibitions, displays, and concerts. The invention simplifies the fabrication of the truss by reducing the number of parts required and by simplifying the assembly process. The truss is assembled from precut lengths of tubing (chords), prefitted with end connectors, and "V-shaped" members. The V-shaped members are slid onto the chords and fixed in place by pins or other fixings. The V-shaped members are designed with bosses, or hollow cylindrical duct segments, which make a tight fit for the chords to provide the necessary stiffness, making the truss act as an inverted V-shaped girder. This shape allows the trusses to stack.

Further, the invention enables the truss to be assembled from a small number of components. It utilizes simply V-shaped members and chords. The V-shaped members may be mass produced using conventional manufacturing processes. The V-shaped members and the chords can be quickly fitted together by unskilled labor.

The truss can also be made to any convenient length by using additional ones of the V-shaped members. The V-shaped members may be made from lightweight die-cast aluminum or injection-molded reinforced plastic. The chords may likewise be made from either aluminum or plastic composites such as carbon fiber reinforced plastic.

The design of the V-shaped member enables the creation of a triangular truss of equilateral cross section that does not require bracing in the bottom plane. Because there is no bracing in the bottom plane, trusses may be stacked on top of each other in a nested manner. This is an efficient, high-density packing arrangement which is a great advantage in a truss which will be stored when not in use and disassembled and transported from place-to-place for use.

Further, when using the same V-shaped members, the strength of the truss can be varied by adding V-shaped members and adjusting the spacing of the V-shaped members on the chords and/or varying the wall thickness of the chord tubes.

The great advantage of the invention is that the truss can be transported internationally in component form and assembled by unskilled labor at local areas where the truss is to be used.

The corresponding structures, materials, acts, and equivalents of all means or step plus function elements in the claims below are intended to include any structure, material, or act for performing the function in combination with other claimed elements as specifically claimed.

I claim:

1. A method of assembling a lightweight stackable truss for use in temporary, demountable construction comprising the steps of:

providing precut lengths of elongated support members, each elongated support member having first and second ends;

providing a plurality of individual V-shaped members each having an apex and two depending diverging legs forming an ultimate end opposite the apex of each of said V-shaped members, each leg having an outer end;

associating bracket means with the apex of each V-shaped member and with each leg outer end for receiving a corresponding elongated support member; and detachably connecting each of said elongated support members to a corresponding one of said bracket means on a plurality of spaced ones of said individual V-shaped members to create a V-shaped stackable truss having an apex and a continuous open side opposite said apex and that may be stacked for storage.

2. The method of claim 1 further comprising the step of providing precut lengths of hollow tubes as said precut lengths of elongated support members.

3. The method of claim 2 further comprising the steps of:

forming each of the bracket means associated with the apex of each V-shaped member and with each leg outer end as a hollow cylindrical duct segment; and sliding a precut length of said hollow tube through corresponding ones of said hollow cylindrical duct segments on the V-shaped members to form said V-shaped stackable truss.

4. The method of claim 3 further comprising the steps of:

forming aligned orifices in each of said hollow cylindrical duct segments and its corresponding hollow tube; and inserting a removable pin in said aligned orifices to rigidly connect each of said hollow tubes to its corresponding V-shaped member.

5. The method of claim 1 further comprising the steps of:

increasing the strength of said V-shaped stackable truss by increasing the number of individual V-shaped members detachably connected to said elongated support members; and decreasing the spacing between individual ones of said increased number of V-shaped members.

6. The method of claim 1 further comprising the step of forming each of said V-shaped members and said elongated support members of die-cast aluminum.

7. The method of claim 1 further comprising the step of forming said individual V-shaped members and said elongated support members of carbon fiber reinforced plastic.

8. The method of claim 1 further comprising the step of providing precut lengths of I-beams as said precut lengths of elongated support members.

9. The method of claim 8 further comprising the steps of:

forming at least a portion of each of said bracket means associated with the apex of each V-shaped member and each leg outer end as an inverted T-shaped hollow bracket so as to receive at least a portion of said I-beam; and sliding a precut length of said I-beam through corresponding ones of said T-shaped hollow brackets on the V-shaped members to form said V-shaped stackable truss.

10. The method of claim 9 further comprising the steps of:

forming aligned orifices in each of said T-shaped hollow brackets and its associated I-beam; and inserting a removable pin in said aligned orifices to rigidly connect each of said I-beams to its corresponding V-shaped member.

11. The method of claim 2 further comprising the step of forming spaced, aligned slots in each of said hollow tubes.

12. The method of claim 11 further comprising the steps of:

forming each of said bracket means associated with the apex of each individual V-shaped member and with each leg outer end as an arcuate segment with a plate extending vertically outwardly from the arcuate segment; and placing a precut length of said hollow tube on corresponding ones of said arcuate segments on the individual V-shaped members such that the vertical plate is inserted in a corresponding aligned slot.

13. The method of claim 12 further comprising the steps of:

forming aligned orifices in each of said plates and its corresponding hollow tube; and inserting a removable pin in said aligned orifices to rigidly connect each of said hollow tubes to its corresponding V-shaped member arcuate segments.

14. The method of claim 1 further comprising the steps of:

providing mating connectors on said first and second ends of each of said elongated support members; and attaching corresponding ones of said mating connectors together for connecting at least two V-shaped trusses together to increase the length of the truss.

15. A lightweight stackable truss for use in temporary, demountable construction comprising:

precut lengths of elongated support members having first and second ends;

a plurality of individual V-shaped members, each having an apex and two depending diverging legs forming an open side on each of said V-shaped members opposite said apex, each leg having an outer end;

bracket means associated with the apex of each V-shaped member and with each leg outer end for receiving a corresponding elongated support member; and each of said elongated support members being detachably connected to a corresponding one of said bracket means on a plurality of spaced ones of said individual V-shaped members to create a V-shaped stackable truss having a continuous open side to enable stacking of a plurality of said V-shaped trusses.

16. The stackable truss of claim 15 further comprising precut lengths of hollow tubes used as said elongated support members.

17. The stackable truss of claim 16 further comprising:

a hollow cylindrical duct segment used as said bracket means associated with the apex of each V-shaped member and each leg outer end; and each of corresponding ones of said hollow cylindrical duct segments on said V-shaped member slidably receiving a precut length of hollow tube to form said V-shaped stackable truss.

18. The stackable truss of claim 17 further comprising:

aligned orifices in each of said hollow cylindrical duct segments and its corresponding hollow tube; and a removable pin inserted in said aligned orifices to rigidly connect each of said hollow tubes to its corresponding V-shaped V-shaped member.

19. The stackable truss of claim 15 further comprising a V-shaped truss having a predetermined strength as determined by the number and spacing of said V-shaped members attached to a support member of precut length.

20. The stackable truss of claim 16 further comprising spaced, aligned slots in each of said hollow tubes.

21. The stackable truss of claim 20 further comprising:

an arcuate segment forming each of said bracket means for receiving a corresponding one of said hollow tubes;

a plate extending vertically outwardly from each arcuate segment; and one of said spaced, aligned slots in a hollow tube receiving a corresponding plate from a corresponding arcuate segment to form said V-shaped truss.

22. The stackable truss of claim 21 further comprising:

aligned orifices in each of said plates and its corresponding hollow tube; and a removable pin inserted in said aligned orifices to rigidly connect each of said hollow tubes to its corresponding V-shaped member arcuate segment.

* * * * *